United States Patent [19]

Gorski

[11] Patent Number: 4,803,009

[45] Date of Patent: Feb. 7, 1989

[54] STABILIZED AZEOTROPE OR AZEOTROPE-LIKE COMPOSITION OF 1,1,2-TRICHLORO-1,2,2-TRIFLUOROETHANE, METHANOL AND 1,2-DICHLOROETHYLENE

[75] Inventor: Robert A. Gorski, Newark, Del.

[73] Assignee: E. I. Du Pont de Nemours and Company, Wilmington, Del.

[21] Appl. No.: 151,539

[22] Filed: Feb. 2, 1988

[51] Int. Cl.[4] ..... C11D 7/30; C11D 7/50

[52] U.S. Cl. ..... 252/171; 252/162; 252/170; 252/172; 252/364

[58] Field of Search ..... 252/162, 170, 171, 172, 252/364

[56] References Cited

U.S. PATENT DOCUMENTS 2,797,250 6/1957 Copelin ..... 252/171

3,455,835 7/1969 Burt ..... 252/172

3,629,128 12/1971 Rains ..... 252/171

3,852,367 12/1974 Katsuragawa et al. ..... 252/171

3,960,746 6/1976 Gorski ..... 252/171

*Primary Examiner*—Robert A. Wax

*Attorney, Agent, or Firm*—J. E. Shipley

[57] ABSTRACT

A stabilized azeotrope or azeotrope-like composition is disclosed comprising an azeotrope or azeotrope-like composition of 1,1,2-trichloro-1,2,2-trifluoroethane, methanol and 1,2-dichloroethylene and about 0.001 to 0.004 wt. percent of a lower alkoxyphenol, about 0.01 to 1.0 wt. percent 1,2-butylene oxide, about 0.01 to 1.0 wt. percent diisopropylamine and at least one of about 0.01 to 1.0 wt. percent nitromethane and about 0.01 to 1.0 wt. percent 1,2-propylene oxide, said wt. percents based on the weight of the azeotrope or azeotrope-like composition.

16 Claims, No Drawings

STABILIZED AZEOTROPE OR AZEOTROPE-LIKE COMPOSITION OF 1,1,2-TRICHLORO-1,2,2-TRIFLUOROETHANE, METHANOL AND 1,2-DICHLOROETHYLENE

BACKGROUND OF THE INVENTION

In the pending application Ser. No. 100220, filed Sept. 23, 1987, an azeotrope-like composition comprising 1,1,2-trichloro-1,2,2-trifluoroethane, methanol and 1,2-dichloroethylene was disclosed as an effective cleaning solvent composition, particularly in cleaning modern electronic circuit boards.

As indicated in the above-cited application, the current industrial processes for soldering electronic components to circuit boards involve coating the entire circuit side of the board with a flux composition and, thereafter, passing this coated side of the board over preheaters, and then through molten solder. The flux composition cleans the conductive metal parts and promotes adhesion of the solder. Commonly used fluxes consist, for the most part of rosin used alone or with activating additives such as amine hydrochlorides or oxalic acid derivatives.

After soldering, which thermally degrades part of the rosin, flux and flux residues are often removed from the board with an organic solvent composition.

Since requirements for the removal of contaminants from circuit boards are very stringent, most current industrial circuit board cleaning processes involve the use of vapor defluxing techniques. In a conventional operation of a vapor defluxer, the board is passed through a sump of boiling organic solvent which removes the bulk of the rosin (including thermally degraded rosin), and thereafter through a sump containing freshly distilled solvent, and finally through solvent vapor over a boiling sump which provides a final rinse with a clean solvent which condenses on the circuit board. In addition, the board can also be sprayed with distilled solvent before the final rinse.

While the azeotrope or azeotrope-like composition of 1,1,2-trichloro-1,2,2-trifluoroethane, methanol, and 1,2-dichloroethylene is an excellent solvent system for cleaning circuit boards, for practical industrial use, this solvent system, as is the case with any solvent system, should be stabilized against compositional changes during both use and long term storage. Changes, such as oxidation, polymerization, interaction of components and the like, may generate products which adversely affect the circuit boards being cleaned or the solvent composition itself.

It is therefore an object of the present invention to provide an azeotrope or an azeotrope-like composition of 1,1,2-trichloro-1,2,2-trifluoroethane, methanol and 1,2-dichloroethylene which is stable during use and long term storage and which minimizes the formation of undesirable reaction products which may adversely affect the cleaning of electronic circuit boards.

SUMMARY OF THE INVENTION

A stabilized azeotrope or azeotrope-like composition has been discovered comprising effective amounts of 1,1,2-trichloro-1,2,2-trifluoroethane, methanol and 1,2-dichloroethylene and effective stabilizing amounts of a lower alkoxyphenol, 1,2-butylene oxide, diisopropylamine and at least one of nitromethane and 1,2-propylene oxide.

DETAILED DESCRIPTION OF THE INVENTION

By effective amounts is meant the amounts of each component of 1,1,2-trichloro-1,2,2-trifluoroethane, methanol, and 1,2-dichloroethylene, which, when combined, results in the formation of the azeotrope of azeotrope-like composition of the instant invention.

By effective stabilizing amounts is meant the amounts of a lower alkoxyphenol, 1,2-butylene oxide, diisopropylamine and at least one of nitromethane and 1,2-propylene oxide which, when combined with the azeotrope or azeotrope-like composition of 1,1,2-trichloro-1,2,2-trifluoroethane, methanol, and 1,2-dichloroethylene, allow such composition to be used and stored commercially, i.e., commercially acceptable appearance, corrosivity and resistance to loss of integrity.

The stabilized azeotrope or azeotrope-like composition of the present invention comprises admixtures of effective amounts of 1,1,2-trichloro-1,2,2-trifluoroethane, methanol, and 1,2-dichloroethylene which compositions form azeotropes or azeotrope-like compositions and may contain about 0.001 to 0.004 wt. percent of a lower alkoxyphenol, about 0.01 to 1.0 wt. percent 1,2-butylene oxide, about 0.01 to 1.0 wt. percent diisopropylamine and at least one of about 0.01 to 1.0 wt. percent nitromethane and about 0.01 to 1.0 wt. percent 1,2-propylene oxide, said wt. percents based on the weight of the azeotrope or azeotrope-like composition. 1,2-dichloroethylene can exist in two different isomeric forms, the trans-1,2-dichloroethylene and the cis-1,2-dichloroethylene.

As recognized in the art, an azeotrope or an azeotrope-like composition is an admixture of two or more different components which, when in liquid form under given pressure, will boil at a substantially constant temperature, which temperature may be higher or lower than the boiling temperatures of the components, and which will provide a vapor composition essentially identical to the liquid composition undergoing boiling. The essential features of an azeotrope or an azeotrope-like composition are that at a given pressure, the boiling point of the liquid composition is fixed and that the composition of the vapor above the boiling composition is essentially that of the boiling liquid composition, i.e., substantially no fractionation of the components of the liquid composition takes place. It is also recognized in the art that both the boiling point and the weight percentages of each component of the azeotropic composition may change when the azeotrope or azeotrope-like liquid composition is subjected to boiling at different pressures. Thus, an azeotrope or an azeotrope-like composition may be defined in terms of the unique relationship that exists among components, or in terms of the compositional ranges of the components, or in terms of exact weight percentages of each component of the composition characterized by a fixed boiling point at a specified pressure.

The present azeotrope or azeotrope-like composition comprises admixtures of 1,1,2-trichloro-1,2,2-trifluoroethane, methanol and 1,2-dichloroethylene, more specifically, the present composition comprises a mixture of about 64 to 72 weight percent 1,1,2-trichloro-1,2,2-trifluoroethane, about 5 to 7 weight percent methanol and about 23 to 29 weight percent trans-1,2-dichloroethylene. Additionally, the present composition comprises azeotrope or azeotrope-like admixtures of about 93 weight percent 1,1,2-trichloro-1,2,2-trifluoroethane, about 6 weight percent methanol and about 1 weight percent cis-1,2-dichloroethylene.

Each of the components of the present azeotrope or azeotrope-like composition is known in the art. It is not possible to predict the formation of azeotropes. Therefore, it was surprising and unexpected that each of the isomeric forms of 1,2-dichloroethylene with 1,1,2-trichloro-1,2,2-trifluoroethane and methanol form azeotrope of azeotrope-like mixtures with drastically different compositions. The 1,2-dichloroethylene may contain varying quantities of both trans-1,2-dichloroethylene and cis-1,2-dichloroethylene; for example, trans-1,2-dichloroethylene may contain about 5 weight percent cis-1,2-dichloroethylene.

A mixture containing about 68 weight percent 1,1,2-trichloro-1,2,2-trifluoroethane, about 6 weight percent methanol, and about 26 weight percent trans-1,2-dichloroethylene which boils at 38.4° C. at atmospheric pressure (760 mm Hg) constitutes a minimum boiling azeotrope. Additionally, an azeotrope is formed containing about 93 weight percent 1,1,2-trichloro-1,2,2-trifluoroethane, about 6 weight percent methanol and about 1 weight percent cis-1,2-dichloroethylene which azeotrope boils at about 39.7° C. at atmospheric pressure (760 mm Hg).

The above azeotropes, particularly the azeotrope containing trans-1,2-dichloroethylene are effective solvents for cleaning circuit boards. Such solvent compositions are characterized by highly desirable properties of relatively low boiling points, non-flammability, relatively low toxicity and high solvency for flux and flux residues. The components also permit easy recovery and reuse without loss of their desirable characteristics because of their azeotropic nature and relatively low boiling point.

While the azeotrope or azeotrope-like composition of 1,1,2-trichloro-1,2,2-trifluoroethane, methanol and trans-1,2-dichloroethylene performs outstandingly in the vapor defluxing process in cleaning circuit boards, it is recognized that in order to take practical advantage of the unique properties of this solvent composition, certain other desirable properties should be imparted to the composition, particularly, when the solvent system is to be used industrially.

One such desirable property is storage stability. It is recognized that any material which is to be used commercially must usually be inventoried. Such storage can be for a short term or a longer period of months or even years. Thus, for a solvent composition to be useful, it should be stabilized against any significant deleterious changes which may be brought about by oxidation, polymerization or interaction of components. Such changes may result in discoloration of the solvent, the formation of undesirable by-products such as acids and/or the formation of insoluble polymeric materials. It has been found that the addition of lower alkoxyphenols, the concentrations which may vary from about 0.001 to 0.004 weight percent and 1,2-butylene oxide at concentrations which may vary from about 0.01 to 1.0 weight percent perform as effective storage stabilizers. By lower alkoxyphenol is meant methoxyphenol, ethoxyphenol and propoxyphenol, the preferred alkoxyphenol being methoxyphenol, and more preferred, 4-methoxyphenol. Higher concentrations of alkoxyphenol and 1,2-butylene oxide may be used but higher concentrations generally do not offer additional advantages under normal conditions.

Another commercially desirable characteristic to be imparted to the solvent system is stability during use. For example, as described above in the vapor defluxing cleaning procedure, the circuit board to be cleaned is first passed through a sump containing boiling solvent for the removal of the bulk of the rosin, including thermally degraded rosin. In this sump, the organic solvent is in contact with a heating source for a prolonged time. After passage through the first sump, the circuit board is passed through a sump containing freshly distilled solvent and finally through solvent vapor over a boiling sump which provides a final rinse with a clean solvent which condenses on the circuit board. Thus, in use, the organic solvent is subjected to constant heating either in maintaining boiling sumps or in vaporizing the solvent to provide freshly distilled solvent or vapor to condense on the circuit board for the final rinse. It is, therefore, highly desirable to minimize any change in the solvent system which can adversely affect the cleaning process or degrade the integrity of the solvent. As mentioned earlier, such changes may be due to oxidation, polymerization or interaction among the components of the solvent system. For example, one such interaction which should be minimized is the interaction between 1,1,2-trichloro-1,2,2-trifluoroethane and methanol which reaction may generate acidic products and free chloride ions. As indicated in my earlier U.S. Pat. No. 3,960,746 (Gorski) the combination of 1,1,2-trichloro-1,2-trifluoroethane and lower alcohols, particularly methanol, may attack reactive metals such as zinc and aluminum as well as certain aluminum alloys often used as materials of construction in circuit board cleaning. It has been found that nitromethane may be incorporated in the present solvent system in concentrations of from about 0.01 to about 1.0 weight percent and effectively retard this attack.

Another unusual and unexpected aspect of the present stabilized azeotrope or azeotrope-like composition is the role of diisopropylamine. In the presence of a lower alkoxyphenol and 1,2-butylene oxide, diisopropylamine, in combination with either nitromethane or 1,2-propylene oxide, or both, provides outstanding stability to the present solvent system. 1,2-propylene oxide, if present, can be present in concentrations of from about 0.01 to about 1.0 weight percent. Diisopropylamine can be used in the concentration range of from about 0.01 to about 1.0 weight percent. Both weight percentages are based on the weight of the azeotrope or azeotrope-like composition of 1,1,2-trichloro-1,2,2-trifluoroethane, methanol and 1,2-dichloroethylene.

As shown in the example, the stabilizers used in the present solvent system, a lower alkoxyphenol, 1,2-butylene oxide, diisopropylamine, nitromethane and 1,2-propylene oxide appear to stabilize the solvent by working interdependently with diisopropylamine as the key ingredient. Higher concentrations of each stabilizer that those indicated may be used but higher concentrations generally do not offer additional advantages under normal conditions.

A stabilized azeotrope or azeotrope-like composition of the present invention may contain from about 64 to 72 weight percent of 1,1,2-trichloro-1,2,2-trifluoroethane, about 5 to 7 weight percent methanol and about 23 to 29 weight percent trans-1,2-dichloroethylene and, based on the the weight of the azeotrope or azeotrope-like composition, about 0.001 to 0.004 weight percent lower alkoxyphenol, about 0.01 to 1.0 weight percent 1,2-butylene oxide, about 0.01 to 1.0 weight percent diisopropylamine and at least one of nitromethane at about 0.01 to 1.0 weight percent and 1,2-propylene oxide at about 0.01 to 1.0 weight percent. Preferably, the stabilized composition contains both nitromethane and 1,2-propylene oxide and the lower alkoxyphenol is 4-methoxyphenol.

More preferably, the stabilized composition of the present invention contains about 69 weight percent 1,1,2-trichloro-1,2,2-trifluoroethane, about 6 weight percent methanol and about 25 weight percent trans-1,2-dichloroethylene and, based on the weight of the azeotorpe or azeotorpe-like composition, about 0.0026 weight percent lower alkoxyphenol, about 0.026 weight percent 1,2-butylene oxide, about 0.1 weight percent diisopropylamine, and at least one of nitromethane at about 0.2 weight percent and 1,2-propylene oxide at about 0.1 weight percent. Most preferably, this stabilized composition contains both the nitromethane and the 1,2-propylene oxide and the lower alkoxyphenol is 4-methoxyphenol.

The present invention thus provides a stabilized azeotrope or azeotrope-like composition of 1,1,2-trichloro-1,2,2-trifluoroethane, methanol and trans-1,2-dichloroethylene which can be stored for a long period of time and which undergoes little or no change during commercial usage and storage and which minimizes corrosion of aluminum.

The lower alkoxyphenols, 1,2-butylene oxide, diisopropylamine, nitromethane, and 1,2-propylene oxide and their methods of preparation are known in the art.

The composition of the instant invention can be prepared by any convenient method, including weighing desired quantities of each component and, thereafter, mixing the desired amounts of the components in a suitable container.

EXAMPLES

Seven-day stability tests of a solvent combination of 68 weight percent 1,1,2-trichloro-1,2,2-trifluoroethane, 6 weight percent methanol and 26 weight percent trans-1,2-dichloroethylene were carried out by refluxing 150 ml. of the solvent combination in a 500 ml. "Pyrex" flask using 90% water-saturated solvent (room temperature), with the indicated stabilizers. The flasks were connected to water-cooled condensers which in turn were connected to "Drierite"-desiccant tubes to keep ambient air moisture from entering the flasks. Additionally, stainless steel (SS-304) specimens were located at the solvent vapor/air interfaces in the condensers and coupled stainless steel SS-304/aluminum alloy Al-7075 specimens were located in the boiling liquids.

After the conclusion of the tests, the following determinations were made:

1. Increase in the chloride concentrations ($Cl^-$). The tested solvent was extracted with an equal volume of distilled water and analyzed for chloride concentration. The corrosion products on the specimens were carefully removed by sliding a knife over the metal surface without removing base metal. These scrapings were added into each appropriate flask which had been used in that particular test. Then 100 ml. of 5% sulfuric acid was added to each flask to scrub the flask walls and to dissolve the corrosion products. This solution was analyzed for chloride ion concentration. The combined chloride ion determinations minus any chloride ion in the original solvent is expressed as an increase in the chloride ion concentration ($Cl^-$ ppm). This increase in the chloride ion concentration represents the loss in the integrity of the components of the solvent system and is usually accompanied by an increase in acidity.

2. The corrosion rates were determined by rubbing the metal surfaces with ink and pencil erasers, brushing the surfaces, rinsing in 1,1,2-trichloro-1,2,2-trifluoroethane, distilled water and acetone, sequentially, and, thereafter, drying for a minimum of 24 hours over "Drierite" desiccant, and then weighing the metal specimens to ±0.0001 g. The loss in weight of the metal specimen is expressed in terms of mils/year. From the present tests, the corrosion rate of aluminum Al-7075 of 4 mils per year or less was considered to be acceptable.

3. Additionally, the appearance of the solvent and the aluminum alloy specimens were rated visually using the following criteria:

| Rating | Acceptable | Appearance Liquid | Al-7075 |
|---|---|---|---|
| 0 | Yes | clear, colorless | bright, shiny |
| 1 | Yes | clear, very slight darkening | very, very slight deposit |
| 2 | Borderline | clear, slightly darkened | very slight deposit/pitting |
| 3 | No | gel at vapor/liquid/glass interface | slight deposit/pitting |
| 4 | No | moderate precipitate | moderate deposit/pitting |
| 5 | No | severe precipitate | severe deposits |

The examples are summarized in Table 1. The following is the key to the abbreviations used to indicate the various inhibitors used in the examples.

1,2-BO—1,2-butylene oxide
NM—nitromethane
DIPA—diisopropylamine
1,2-PO—1,2-propylene oxide
4-MP—4-methoxyphenol

TABLE I

| Ex. | Inhibitor | Conc. (Wt. %) | $Cl^-$ (ppm) | Al 7075 Corr. Rate (mils/yr) | Visual Rating Liq | Visual Rating Al |
|---|---|---|---|---|---|---|
| 1 | 4-MP | 0.0026 | 1 | 3 | 0 | 0 |
| | 1,2-BO | 0.026 | | | | |
| | NM | 0.20 | | | | |
| | DIPA | 0.10 | | | | |
| 2 | 4-MP | 0.0026 | 0.8 | 1 | 0 | 0 |
| | 1,2-BO | 0.026 | | | | |
| | NM | 0.80 | | | | |
| | DIPA | 0.40 | | | | |
| 3 | 4-MP | 0.0026 | 1 | <0.1 | 0 | 0 |
| | 1,2-BO | 0.026 | | | | |
| | 1,2-PO | 0.05 | | | | |
| | DIPA | 0.025 | | | | |
| 4 | 4-MP | 0.0026 | 4 | 0.6 | 0 | 0 |
| | 1,2-BO | 0.026 | | | | |
| | 1,2-PO | 0.20 | | | | |
| | DIPA | 0.10 | | | | |
| 5 | 4-MP | 0.0026 | 3 | <0.2 | 0 | 0 |
| | 1,2-BO | 0.026 | | | | |
| | NM | 0.05 | | | | |
| | 1,2-PO | 0.025 | | | | |
| | DIPA | 0.025 | | | | |
| 6 | 4-MP | 0.0026 | 2 | <0.1 | 0 | 0 |
| | 1,2-BO | 0.026 | | | | |
| | NM | 0.20 | | | | |
| | 1,2-PO | 0.10 | | | | |
| | DIPA | 0.10 | | | | |
| 7 | 4-MP | 0.0026 | 1 | 2 | 0 | 0 |
| | 1,2-BO | 0.026 | | | | |
| | NM | 0.20 | | | | |
| | 1,2-PO | 0.10 | | | | |
| | DIPA | 0.10 | | | | |

TABLE I-continued

| Ex. | Inhibitor | Conc. (Wt. %) | $Cl^-$ (ppm) | Al 7075 Corr. Rate (mils/yr) | Visual Rating Liq | Visual Rating Al |
|---|---|---|---|---|---|---|
| 8 | 4-MP | 0.0026 | 4 | 0.2 | 0 | 0 |
| | 1,2-BO | 0.026 | | | | |
| | NM | 0.80 | | | | |
| | 1,2-PO | 0.40 | | | | |
| | DIPA | 0.40 | | | | |

The above examples clearly demonstrate the importance of the combination of 4-methoxyphenol, 1,2-butylene oxide, and diisopropylamine in combination with either nitromethane or 1,2-propylene oxide or both in stabilizing the azeotropic mixture of 1,1,2-trichloro-1,2,2-trifluoroethane, methanol and trans-1,2-dichloroethylene.

EXAMPLE 9

A single sided circuit board was coated with activated rosin flux and soldered by passing the board over a preheater to obtain a top side board temperature of approximately 200° F. and then through 500° F. molten solder. The soldered board was defluxed in an azeotropic mixture of 69 weight percent 1,1,2-trichloro-1,2,2-trifluoroethane, 6 weight percent methanol and 25 weight percent trans-1,2-dichloroethylene containing, based on the weight of the azeotropic mixture, 0.0026 weight percent 4-methoxypheno, 0.026 weight percent 1,2-butylene oxide, 0.20 weight percent nitromethane, 0.10 weight percent 1,2-propylene oxide and 0.10 weight percent diisopropylamine, by suspending it, first, for two minutes in the boiling sump, then, two minutes in the rinse sump, and, thereafter, for one minute in the solvent vapor above the boiling sump. The board, thus cleaned, had no visible residue remaining on it.

I claim:

1. A stabilized azeotrope or azeotrope-like composition comprising a mixture of about 64 to 72 weight percent 1,1,2-trichloro-1,2,2-trifluoroethane, about 5 to 7 weight percent methanol and about 23 to 29 weight percent trans-1,2-dichloroethylene and effective stabilizing amounts of a lower alkoxyphenol, 1,2-butylene oxide, diisopropylamine and at least one of nitromethane and 1,2-propylene oxide.

2. The stabilized azeotrope or azeotrope-like composition of claim 1 wherein the effective stabilizing amounts are about 0.001 to 0.004 wt. percent of a lower alkoxyphenol, about 0.01 to 1.0 wt. percent 1,2-butylene oxide, about 0.01 to 1.0 wt. percent diisopropylamine and at least one of about 0.01 to 1.0 wt. percent nitromethane and about 0.01 to 1.0 wt. percent 1,2-propylene oxide, said wt. percents based on the weight of 1,1,2-trichloro-1,2,2-trifluoroethane, methanol and trans-1,2-dichloroethylene.

3. The stabilized azeotrope or azeotrope-like composition of claim 2 wherein both nitromethane and 1,2-propylene oxide are present.

4. The stabilized azeotrope or azeotrope-like composition of claim 3 wherein the lower alkoxyphenol is 4-methoxyphenol.

5. The stabilized azeotrope or azeotrope-like composition of claim 1 wherein the effective amounts are about 69 weight percent 1,1,2-trichloro-1,2,2-trifluoroethane, about 6 weight percent methanol, about 25 weight percent trans-1,2-dichloroethylene.

6. The stabilized azeotrope or azeotrope-like composition of claim 5 wherein both nitromethane and 1,2-propylene oxide are present.

7. The stabilized azeotrope or azeotrope-like composition of claim 6 wherein the lower alkoxyphenol is 4-methoxyphenol.

8. The composition of claim 2 wherein the effective stabilizing amounts are about 0.0026 weight percent 4-methoxyphenol, about 0.026 weight percent 1,2-butylene oxide, about 0.1 weight percent diisopropylamine and at least one of about 0.2 weight percent nitromethane and about 0.1 weight percent 1,2-propylene oxide, said wt. percents based on the weight of 1,1,2-trichloro-1,2,2-trifluoroethane, methanol and trans-1,2-dichloroethylene.

9. The stabilized azeotrope or azeotrope-like composition of claim 8 wherein both nitromethane and 1,2-propylene oxide are present.

10. The composition of claim 5 wherein the effective stabilizing amounts are about 0.0026 weight percent 4-methoxyphenol, about 0.026 weight percent 1,2-butylene oxide, about 0.1 weight percent diisopropylamine and at least one of about 0.2 weight percent nitromethane and about 0.1 weight percent 1,2-propylene oxide, said wt. percents based on the weight of 1,1,2-trichloro-1,2,2-trifluoroethane, methanol and trans-1,2-dichloroethylene.

11. The stabilized azeotrope or azeotrope-like composition of claim 10 wherein both nitromethane and 1,2-propylene oxide are present.

12. A process for cleaning a solid surface which comprises treating said surface with the composition of claim 1.

13. The process of claim 12 wherein the solid surface is a printed circuit board contaminated with flux and flux residues.

14. A stabilized azeotrope or azeotrope-like composition comprising about 93 weight percent 1,1,2-trichloro-1,2,2-trifluoroethane, about 6 weight percent methanol and about 1 weight percent cis-1,2-dichloroethylene and effective stabilizing amounts of a lower alkoxyphenol, 1,2-butylene oxide, diisopropylamine and at least one of nitromethane and 1,2-propylene oxide.

15. A process for cleaning a solid surface which comprises treating said surface with the composition of claim 14.

16. The process of claim 15 wherein the solid surface is a printed circuit board contaminated with flux and flux residues.

* * * * *